United States Patent [19]

Raketti et al.

[11] Patent Number: 4,584,429

[45] Date of Patent: Apr. 22, 1986

[54] ELECTRICAL ASSEMBLY INCLUDING A METAL ENCLOSURE AND A HIGH VOLTAGE BUSHING

[75] Inventors: Raymond Raketti, Milwaukee; Daniel Schreiber, New Berlin; Andrew J. Orgovan, S. Milwaukee, all of Wis.; George E. Adair, Scarborough, Canada; Lawrence M. Burrage, S. Milwaukee, Wis.

[73] Assignee: Cooper Industries, Inc., Houston, Tex.

[21] Appl. No.: 477,331

[22] Filed: Mar. 21, 1983

[51] Int. Cl.[4] ..... H01B 17/26; H01B 17/44

[52] U.S. Cl. ..... 174/18; 174/31 R; 174/35 GC; 174/142

[58] Field of Search ..... 174/12 BH, 31 R, 35 GC, 174/75 F, 73 R, 142, 143, 18

[56] References Cited

U.S. PATENT DOCUMENTS

| | | | |
|---|---|---|---|
| 2,000,688 | 5/1935 | Burr et al. | 174/12 BH X |
| 2,209,003 | 7/1940 | Rorden | 174/142 X |
| 2,885,459 | 5/1959 | Pulsifer et al. | 174/35 GC |
| 3,055,968 | 9/1962 | Spiece | 174/31 R |
| 3,784,733 | 1/1974 | Farmer et al. | 174/142 X |

FOREIGN PATENT DOCUMENTS

| | | | |
|---|---|---|---|
| 454247 | 6/1968 | Switzerland | 174/73 R |

*Primary Examiner*—Laramie E. Askin

*Attorney, Agent, or Firm*—Nelson A. Blish; Eddie E. Scott; Alan R. Thiele

[57] ABSTRACT

A high voltage feed-through bushing has a conductive gasket to connect a conductive coating to a metal enclosure. A central conductor rod of the bushing is surrounded by an insulating tube which is surrounded by a tubular conductor to establish a floating equipotential surface. The central conductor rod is located within a bushing shell by sealing means at the outer and inner ends of the bushing.

19 Claims, 8 Drawing Figures

ELECTRICAL ASSEMBLY INCLUDING A METAL ENCLOSURE AND A HIGH VOLTAGE BUSHING

BACKGROUND OF THE PRESENT INVENTION

This invention relates to an electrical high voltage bushing assembly which is particularly suitable for connecting metal enclosed high voltage devices to a high voltage circuit in a power distribution system.

In power distribution systems, electrical connection is often made to oil insulated devices, such as reclosers, transformers, circuit breakers, and the like. Typically, the devices are enclosed in a metal clad enclosure which is maintained at a lower voltage than the distribution voltage. Often the enclosure is grounded. In these circumstances, the distribution voltage must be supplied to the device in the interior of a grounded enclosure while avoiding electrical breakdown between the distribution circuit and the grounded enclosures. Such breakdown of the insulating system may involve unacceptably high currents and cause a power outrage. The power connection is normally made through a high voltage electrical bushing assembly. Generally, a conventional feed-through bushing assembly for such high voltage applications includes an elongated tubular housing or shell formed of porcelain. The feed-through bushing intrudes to the inside of the enclosure to connect, or feed, the contained device distribution voltage. A relatively large conductor is coaxially mounted within the porcelain, with the opposite ends of the conductor connected to suitable contact members which are sealed to the ends of the shell by suitable sealing means. The conductor is spaced from the walls of the shell and the annular space surrounding the conductor is partially filled with a suitable high strength dielectric fluid, with a small volume providing for expansion of the fluid under operating conditions being also incorporated. The dielectric fluid is usually an insulating oil. The bushing structure should also avoid high voltages stresses to the extent possible, and where high voltage stresses cannot be avoided, should localize them to areas where their adverse effects can be minimized. Obviously, when one is seeking to connect a device within a grounded structure to distribution line voltage, relatively large differences in voltage exist. Voltage stress is proportional to voltage difference and inversely proportional to the distance between locations at differing voltages. High levels of voltage stress may lead to flashover along the interface between solid and fluid insulators or the puncture of solid or fluid insulating materials, causing electrical fault. High voltage stress may result in a corona. Corona is low current level conduction in the insulating media. Corona discharges are often accompanied by objectional levels of radio interference. The partial breakdown of the insulating media by corona may be followed by ionization and arcing, and may result in high fault currents. Corona in oil will degrade the oil. In order to prevent creation of high voltage stresses, the shell is provided with conductive coatings on the interior and exterior surfaces. Multiple conductive surfaces are used in capacitively graded bushings and may be used to provide a capacitive voltage tap for monitoring and test purposes. In addition, an insulating tube may be disposed within the annular chamber to increase dielectric strength while positively spacing the shell and the center conductor. The insulating tube may incorporate a conductive coating or a tubular conductive shell. Terminal sealing means includes an inner stepped structure with internal clamping of the conductor to the porcelain shell. The lower terminal sealing means consists of a pair of elastomer gaskets which seal between the center conductor and the interior wall of the shell.

The exterior of the bushing shell includes a centrally located annular mounting flange adapted to be clamped in sealing engagement against the device housing, with a suitable insulating gasket to seal the connection. A soft aluminum ring is interposed between the clamp mechanism and the flange. The flange is provided with a conductive coating which extends over the flange portion adjacent the metal clad housing and continues over a substantial portion of the outer surface of the shell located within the metal clad housing. The aluminum ring and clamp unit connects the conductive coating to the device housing to place the coating at a corresponding ground or reference potential. Alternately, where a conductive coating has not been extended to a metallic clamping unit, "U"-shaped conductive clips surrounding the insulating gasket have been used to ground the coating.

The inner end of the bushing disposed within the protective oil is preferably provided with an exterior corona shield, which provides improved electrical potential distribution near the lower end of the bushing. The shield includes a tubular portion which is positioned adjacent to the inner end portion of the conductive coating and a conical portion flaring outwardly and opening towards the end of the conductor connected to the device. The tubular portion is formed of a suitable conductive metal and incorporates a clamping end which is provided with a plurality of edge slots or slits to permit a compression electrical connection with the conductive coating on the housing in conjunction with a clamp. An inner metallic "garter" type coil spring is located between the shell and the conical portion to position the shield and provide a proper centering of the corona shield. The metallic spring is typically formed of beryllium copper and in part provides some electrical grading at the end of the conductive coating. Unfortunately, the metallic spring is a good conductor and functions as an electrode. This spring located in a circumferential groove in the shell creates an undesirable voltage stress across the remaining wall of the shell.

Further, with the very tight clamping of the corona shield in position as normally required, a chamber is defined between the bushing and the corona shield. Care must be taken that air and other gases within the oil not be trapped within such chamber. Air and gases will, of course, change the voltage distribution in the corresponding region, and may stress the porcelain beyond its puncture point.

Although the bushing structure has been found to provide satisfactory application in high voltage environments, the bushing is relatively expensive and has certain disadvantages from a standpoint of maintaining a fully effective bushing construction over long periods of time. For example, application of a conductive coating on the inner bore of the porcelain bushing is expensive and difficult to apply consistently. When silver is used to coat the exterior outer surface near the flange of the shell, an intermediate coating should be applied to provide additional electric field grading at the termination of the silver coating. Further, such metalic coatings must be protected from chemical and mechanical damage by an additional coating. Heat shrink tubing has proved to be a suitable additional coating in many applications. Unfortunately, even heat shrink tubing will not prevent flaking of the silver in all applications. Further, the silver coating and aluminum mounting ring form a joint which is an electrolytic cell and is therefore subject to the corrosion of the members. Unchecked corrosion will eventually cause destruction of the conducting path from the bulk of the silver coating to the device housing. A significant reduction in the conducting path creates a condition which is prone to generation of both external and internal electric discharges. Such a condition, of course, must be avoided to maintain an effective bushing.

The upper region of the stepped bushing with the restraining of the conducting rod at such point creates high pressure points tending to produce chipping of the procelain. The chipping often results in a loosening of the desired fluid-tight connection of the conducting rod and interconnecting top terminal interface and may allow oil to leak out as well as permit the leakage of moisture into the bushing. Any introduction of moisture into the oil significantly reduces the dielectric strength of the oil and thereby the effectiveness of the high voltage bushing.

Thus, although the high voltage bushing heretofore used provided effective usage in electrical feedthrough type bushings, there is a need for a more effective and a less expensive bushing which can be used in a wide range of applications for connecting switch gear and other high voltage devices to power distribution systems.

SUMMARY OF THE PRESENT INVENTION

The present invention is particularly directed to a feed-through high voltage bushing which can be applied in various high voltage connections. The feedthrough bushing is constructed with an elongated tubular insulating housing or shell having a conducting rod passing through the shell and sealed at the opposite ends. An internal insulating tube surrounded by a tubular conductor in close association with the insulating tube surrounds the central conductor rod. The insulating tube separates the high voltage conductor from the shell interior while the tubular conductor establishes an equipotential cylinder along a portion of the axial length of the tube. In accordance with the present invention a coaxial tubular conductor defines a floating equipotential surface. The tubular conductor may be located within the insulating tube or be coated on, or intimately affixed to, its exterior surface. Multiple coaxial tubular conductors isolated from each other may be advantageously used in some applications. In a further feature of the bushing, the bushing shell includes an intermediate mounting flange which is covered with a radio glaze over its surfaces and the adjacent bushing surfaces. The radio glaze is fired to the shell and establishes an intermediately resistive conducting coating intimately affixed to the flange for conductive connection to the device housing. The under surface of the mounting flange is provided with an additional silver or other suitably conductive coating. A conductive sealing gasket, formed of a resilient sealing material in combination with a dispersed conductor, provides a low resistance conductive connection between the silver flanged surface and the device housing. The silver coating extends inwardly from the flange radio glaze ring to an innermost ring of radio glaze. The inner radio glaze further grades the voltage from the high conductivity silver to the insulating porcelain. An insulating glaze is preferably formed between the radio glaze ring and the terminal or innermost end of the shell.

In the construction of the surface conducting means, the sequence preferably consists of application of (1) the radio glaze, (2) the insulating glaze, and (3) finally the silver or other conductive coating. In a preferred embodiment of the invention, the insulating tube is formed of polypropylene which has a dielectric constant essentially equal to the typical oil used in high voltage feedthrough bushings. The coaxial tubular conductor may, most preferably, be fabricated by wrapping a metal foil within layers of a polyester film such as polyethylene terephthalate ("MYLAR") to form a tubular conductive sandwich. Alternately, metalic conductive coatings such as chromium, stainless steel or molybdenum may be sputtered on the exterior surface of the insulating tube.

An effective and inexpensive conductive gasket includes a resilient material, preferably epichlorohydrin, in combination with a plurality of dispersed discrete conductors, particularly staples, which are embedded within the resilient gasket material with exposed surfaces on opposite sides. The staples preferably are formed of one or more elements selected from a group of metals having a electrochemical potential midway between that of silver and aluminum, and establish a resistance in the milliohms range. Bronze is a preferred metal. The multiplicity of staples provides for positive, nondeteriorating contact between the silver coating and the device housing.

In a particularly satisfactory bushing assembly the conductor is a cylindrical rod which passes through the shell, with the opposite ends having threaded terminals. A sealing means at each end includes a T-shaped sealing plug member which abuts the end of the porcelain and surrounds the rod. A radial O-ring seal is located between the end of the bushing and the plug member and an axial O-ring seal is located between the rod and the opening of the plug member. The inner end is sealed by a suitable clamping nut to expose the threaded terminal. The outer sealing assembly includes a plurality of spring washers with suitable thrust washers to the opposite sides thereof. An outer terminal includes a cup-shaped base member threaded onto the rod and projecting downwardly over the sealing assembly to compress the spring washers on the sealing plug member and thereby establish fluid tight connections at both ends of the bushing. The outer end portion of the porcelain bushing is provided with suitable locking notches for receiving locking means passed through the cup-shaped base member to establish a positive nonremovable engagement with the porcelain shell after the spring washers are compressed. An alternative design incorporates integral protrusions within the cup-shaped base member to provide the locking means to the ceramic shell. The sealing means establishes a long-life reliable seal of the housing without danger of chipping the internal portion of the shell.

The inner surface of the shell is coated with a suitable insulating glaze thereby contributing to an effective constant electrical performance over the life of the bushing by maintaining a clean surface during construction and later use. The fired insulating glaze adheres on the bushing surface to promote a final smooth and clean surface which is significant to the electrical performance of the bushing. A corona shield to reduce the voltage stress in the insulating oil and equalize the voltage between the inner structure of the enclosure and adjacent portions of the bushing is advantageous in some applications. The corona shield is a funnel shaped member. A tube portion of the corona shield is electrically connected by a screw adjusted clamp to the innermost portion of the silver coating on the shell. An insulating locating ring is placed in a circumferential groove around the shell where the tube portion of the corona shield joins a conical portion of the corona shield. The insulating locating ring preferably has a circular cross section. Orifices pierce the shield to avoid trapping gases between the shell, the ring and the shield. The shield conical portion is formed with a plurality of opening means which extend into the clamping region significantly past the locating rings. The opening means eliminates the trapping of air or gas beneath the skirt and thereby avoids disturbing the field distribution between the shield and bushing. The insulating ring eliminates creation of high voltage stress points, such as occur with the conventional metallic spring.

DESCRIPTION OF THE DRAWING FIGURES

The drawing furnished herewith illustrates preferred construction of the present invention in which the above advantages and features are clearly disclosed as well as others which will be readily understood from the following description.

DESCRIPTION OF THE ILLUSTRATED EMBODIMENTS

Figure 1:
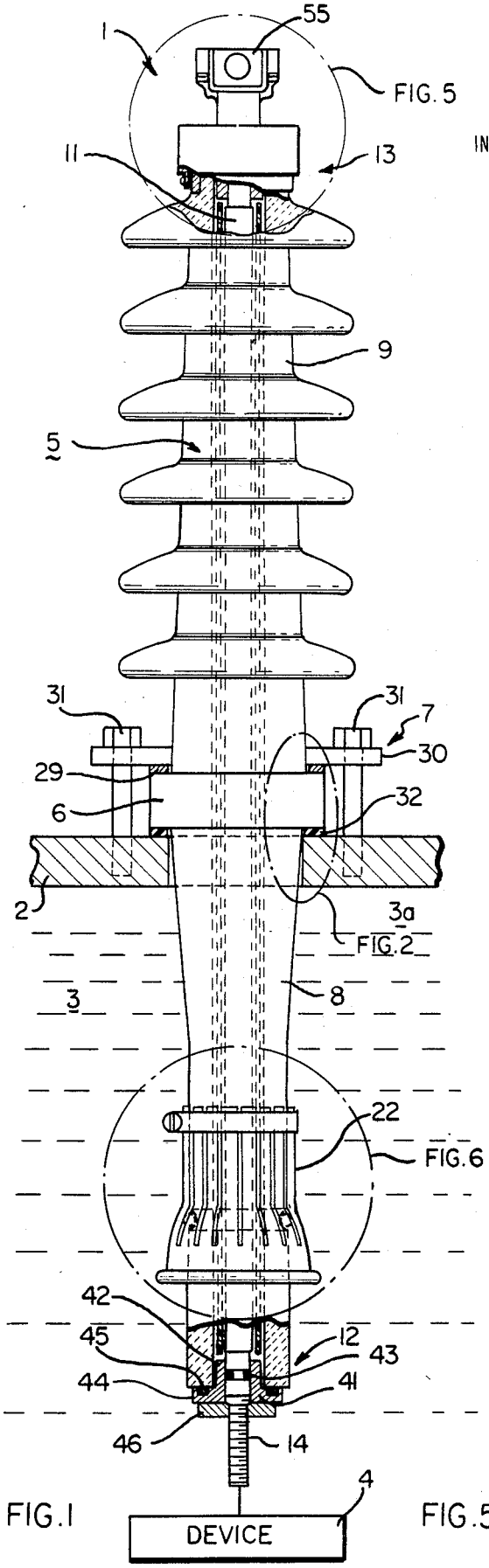
FIG. 1 is a vertical view, partially in longitudinal section of an electrical bushing constructed in accordance, with the invention.
Figure 3:
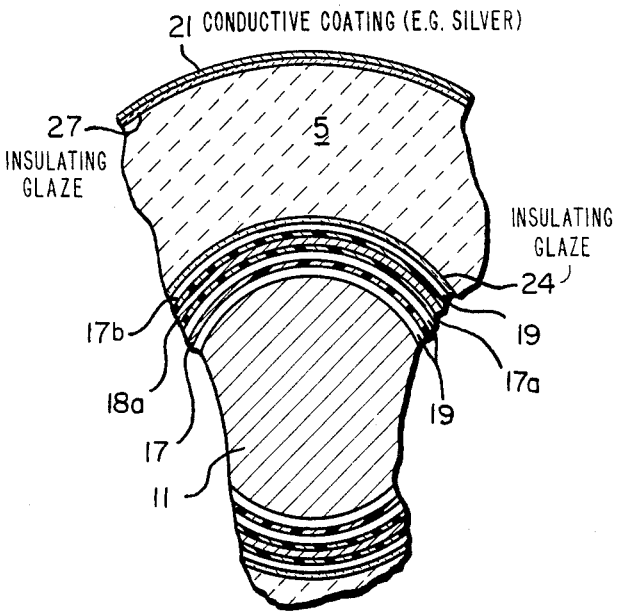
FIG. 3 is a partial horizontal cross-section taken generally on line 3—3 of FIG. 2.
Figure 4:
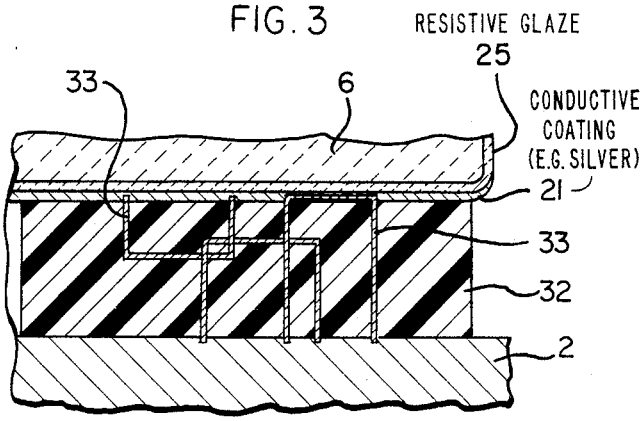
FIG. 4 is a partial enlarged vertical section showing details of a gasket used with the bushing.
Figure 5:
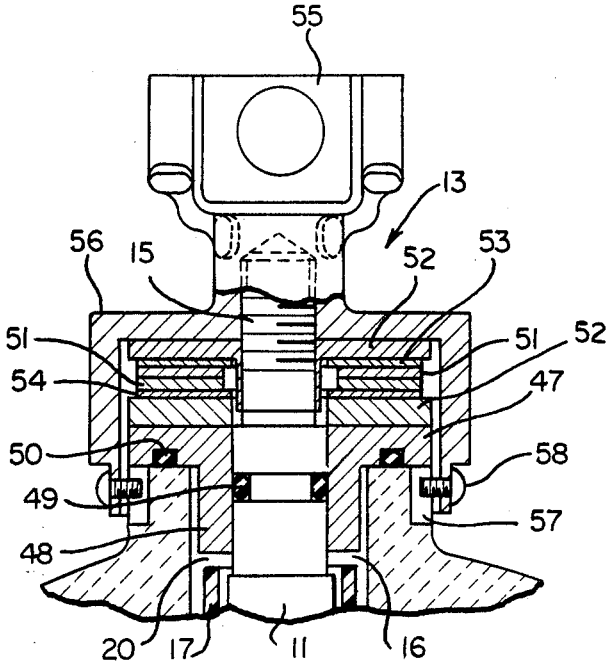
FIG. 5 is an enlarged vertical section taken generally in the region of the dotted circle labeled FIG. 5 in FIG. 1.

Referring to the drawing and particularly to FIG. 1, a high voltage electrical bushing 1 is shown secured to a device housing 2 which is filled with a suitable insulating oil 3. A high voltage device 4, shown in block diagram, is immersed in the oil 3 and connected to a high voltage circuit via the bushing 1.

Figure 7:
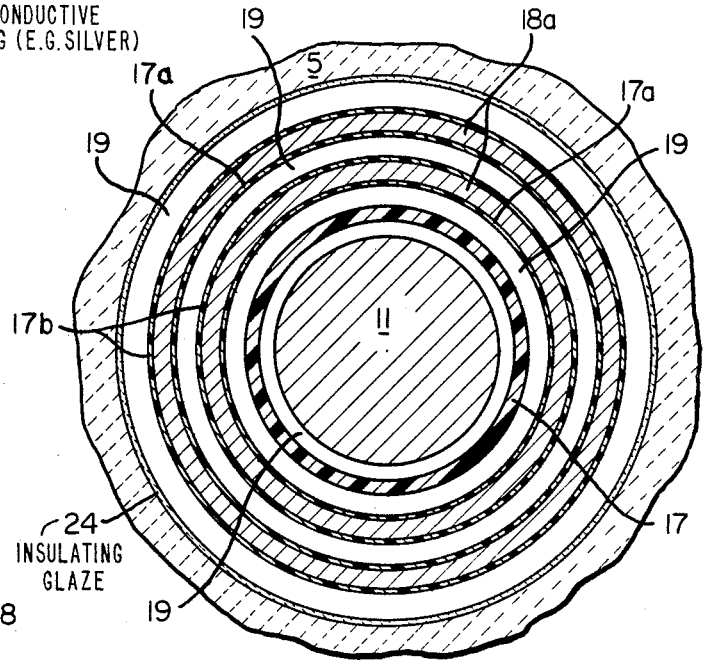
FIG. 7 is a partial cross section similar to the view of FIG. 3, but showing an alternate embodiment of the invention.
Figure 2A:
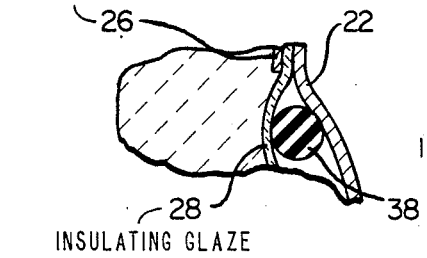
FIG. 2A is an enlarged partial longitudinal section taken generally in the region of the dotted circle labeled FIG. 2A in FIG. 6.

The bushing assembly 1 generally includes an outer insulating shell 5 with an intermediate or generally centrally located exterior mounting flange 6. A clamping unit 7 secures the bushing 1 in a sealed fluid tight relationship to the device housing 2. The inner end or shank 8 of bushing 1 projects inwardly through the gas filled head space 3*a* into the oil 3. The outer portion 9 extends outwardly for connection to the high voltage power supply. A conductor 11 is coaxially mounted within and extends through the elongated tubular shell 5 with the extremities sealed to the corresponding ends of the housing by sealing means 12 and 13. The opposite ends of the conductor 11 include threaded terminals 14 and 15 for interconnection to the device 4 and to the power circuit. The high voltage conductor 11 is shown as a rod member which is spaced from the inner wall of the shell 5 to define an annular chamber 16 therebetween. An insulating tube 17 is located within the annular chamber 16 to positively separate the bushing shell 5 from the conductor 11. As more fully developed hereinafter, a co-axial tubular conductor defines a floating equipotential surface in close association with insulating tube 17. The tubular conductor is most preferably formed by wrapping an aluminum foil 18*a* between layers of "MYLAR"17*a*, 17*b* wound to form a tubular conductive sandwich. The tubular conductive sandwich is slightly spaced from insulating tube 17 to allow dielectric material 19 to infiltrate between them. Multiple tubular conductive sandwiches each separated by dielectric material 19 as illustrated in FIG. 7 may be used. Alternately, a metal coating may be intimately affixed to the exterior surface of insulating tube 17 preferably by sputtering. The tubular conductor controls the distribution of voltage stress between conductor 11 and the exterior of shell 5. The chamber 16 is substantially filled with an insulating oil 19 of a high dielectric strength. An air head 20 is provided at the upper end of the chamber 16 to accommodate the expansion of the oil 19 under operating conditions.

The exterior surface of the bushing housing or shell 5 is provided with a conductive coating 21 from the mounting flange 6 adjacent to the inner end portion to provide a conductive path along the shell 5 and thereby establish an equipotential surface on the shell 5. A corona shield 22 is secured near the inner end portion of the shell 5 in engagement with the inner end of the coating 21. The corona shield 22 reduces the electric field strength and voltage stress in the area between the conductive coating 21 and the inner end of the insulating shell 5 to prevent creation of damaging high voltage stress points. The outer portion of the shell 5 includes a plurality of skirts to establish the desired creepage distance and string distance for a designed service, such as for 150 KV BIL service.

The present invention is particularly directed to the construction of the high voltage bushing assembly 1 and no further description of the associated circuits or device is given other than as necessary to fully and clearlly understand the invention.

In the manufacture of the porcelain shell 5, some warpage can be anticipated. Further, the conductive rod 11 may be an extruded member and will not necessarily be a true cylindrical member. The tube 17 is applied to the conducting rod 11 with a relatively snug fit in contrast to an interference fit. The clearance between conducting rod and tube 17 is generally on the order of twenty thousandths of an inch. The snug fit allows for the insulating layer of oil between them. The insulating tube 17 is telescoped over the conductor rod 11 and extends substantially throughout the length of the conductor 11 within the annular chamber 16. The insulating tube 17 functions to positively prevent contact of the conductor rod 11 with the inner wall of the shell 5. Commercial production tolerances of the shell 5 and the rod 11 are such that actual physical engagement of these elements might occur in the abscence of the insulating tube 17.

In accordance with a significant feature of the present invention, the insulating tube 17 has in close association a tubular conductor along the intermediate portion of the tube 17. The insulating tube 17 is preferably formed of polypropylene as in prior devices, because of the substantially corresponding dielectric constants of the polypropylene and the insulating oil; and the tubular conductor should be formed in close association to the tube 17. The tubular conductor is spaced from the opposite ends of the tube 17 to define an equipotential cylindrical surface essentially coaxial with the shell 5 and extending inwardly and outwardly from the plane of flange 6.

Assuming the rod 11 is at 100 percent voltage or potential and a portion of the exterior surface of the shell 5 is at reference and thus 0% potential, the bushing design is made to produce a particular percentage potential, such as 50%, within the interior of the shell. Further, such distribution should extend over the substantial intermediate length of the shell 5 as defined by the axial length of the tubular conductor. The tubular conductor should throughout the life of the bushing remain essentially continuous and relatively fixed in relationship to the conductor 11 and shell 5 under operating conditions. the tubular conductor is positioned both axially and radially to minimize the voltage stress in three critical regions: in the flange region; in the region of the innermost end of the conductive coating on the shell; and in the region of the lower skirts immediately adjacent flange 6.

Thus, a significant aspect of the invention is the association of a tubular conductor with the insulating tube 17 to produce an electrically floating equipotential surface which functions to properly produce a preselected percentage of line voltage at a desired area between conductor 11 and the exterior surface of the bushing shell 5.

The preferred manner of providing a tubular conductor is to wrap a layer of aluminum foil 18*a* about a hollow mandrel of wrapped polyester film 17*a*. Additional layers of polyester film 17*b* (preferably "MYLAR") overwrap the foil 18*a* layer. The hollow mandrel is telescoped over the central region of tube 17. End shells of wrapped "MYLAR" film maintain the hollow mandrel supporting the aluminum foil in the central region of tube 17.

In an alternate construction of the present invention, a metallic coating is applied by vacuum sputtering of the coating onto the tube 17 to provide a sputtered coated conductor which creates a continuous tubular conductor intimately attached to the tube. Chromium, molybdenum, stainless steel or similar metals are preferred for the coating.

With the conductive coating applied to the insulating tube 17 to form the electrically floating conductor, the tube unit is therefore constructed to maintain the coating fixed under operational conditions of the bushing 1. For example, under operational conditions, the oil temperature may increase to ±105° C. A tube of polypropylene or other plastic may, depending upon the material composition, expand with temperatures and if the expansion is significant, may break the bond to the conductive coating and destroy or at least reduce the desired potential field distribution. Thus, the designer may, of course, readily select the proper material either from available design criteria or simple checking of the material characteristics. For example, if a polypropylene or the like is selected and is determined to be unacceptably temperature dependent when cycled over time, the characteristic might be corrected by heating the tube within an oil bath for an appropriate period.

Further, other coating means might be used. For example, a thin, conductive wire may be tightly wound on an insulating tube to define the equi-potential surface or a conductive foil might be attached to an insulating tube.

A further enhancement of bushing function is provided by glazes and coatings applied to the bushing shell 5. The glazes are essentially vitreous in nature, and strengthen the porcelain by compressing it. An insulating glaze is applied to various areas of the shell 5 to preserve the essentially non-conductive properties of porcelain. A radio glaze, more properly an anti-radio interference glaze, is applied to areas of shell 5 adjacent to the insulating glaze where the exterior of shell 5 will be at reference potential. A conductive coating, preferably of silver, is applied over a portion of the glazes to ensure that a portion of the exterior surface of shell 5 on the inner portion of bushing 1 will be at reference potential. The preferred sequence of applying the glazes and coatings is first the radio glaze, second the insulating glaze and finally the conductive coating. The various glazes and coating should preferably overlap.

The interior wall of the bushing shell 5 is preferably formed with an insulating glaze 24 over the whole length of the shell. The glaze 24 is fired to the wall and provides a smooth, continuous surface which permits an extremely clean interior construction. The smooth wall thus minimizes the problem of dirt and foreign matter which contaminate the oil and otherwise degrade the electrical performance of the bushing.

The tubular conductor electrically floating in combination with the insulating glazed inner wall provides a more effective bushing at a substantially reduced cost when compared to the more conventional internally conductive coated bushing.

Figure 2:
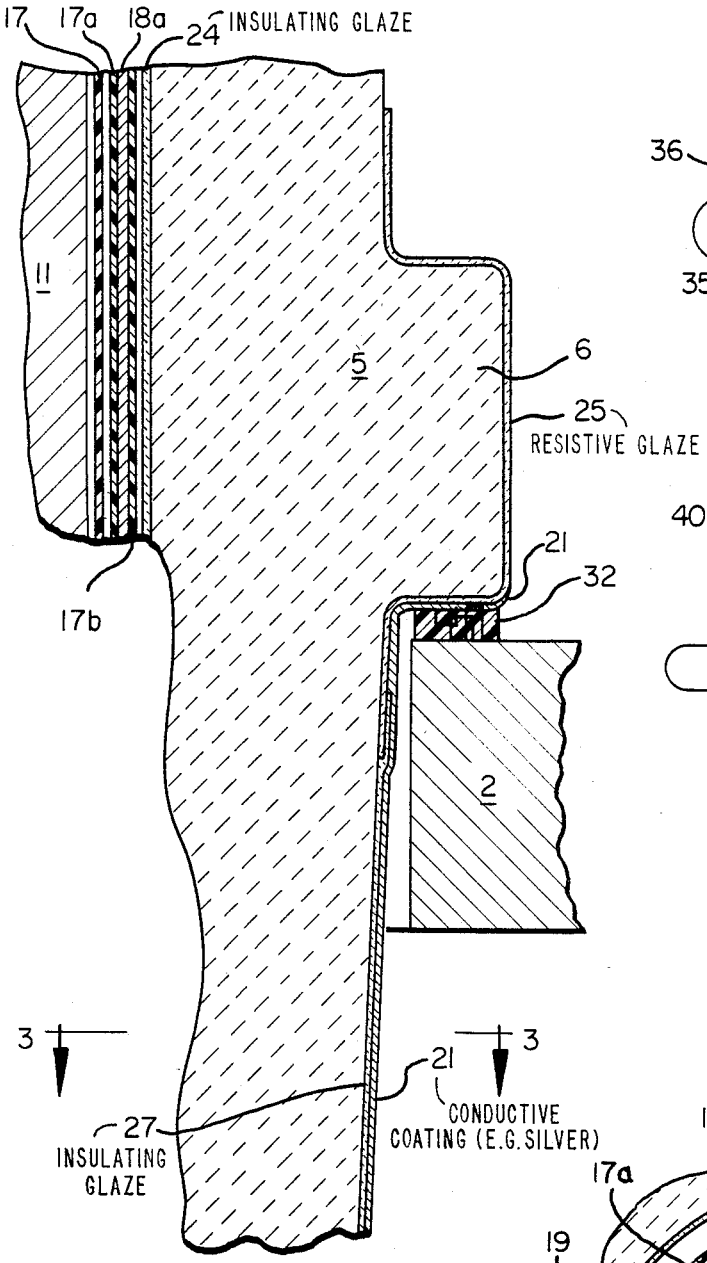
FIG. 2 is an enlarged partial longitudinal section taken generally in the region of the dotted circle labeled FIG. 2 in FIG. 1.
Figure 6:
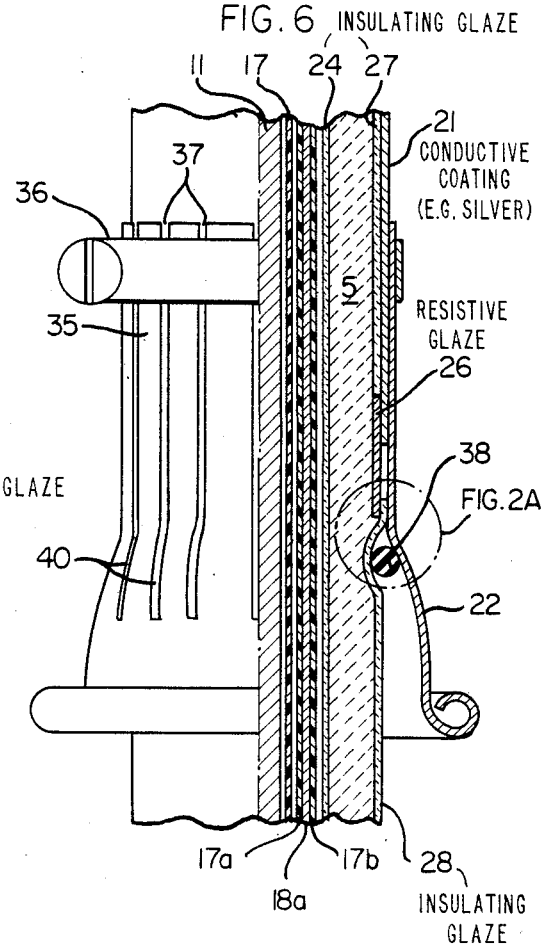
FIG. 6 is an enlarged vertical section taken generally in the region of the dotted circle labeled FIG. 6 in FIG. 1.

The exterior surface of the bushing shell 5 is provided with a coated conductor 21 which is electrically connected to the device housing by the clamping unit 7. The conductor 21 is preferably silver and extends from beneath the flange 6 only and then inwardly into spaced relation to the innermost end of the porcelain shell 5 and terminal 14. In accordance with the illustrated embodiment of the invention, the outer conductive coating 21 and glazes are applied as follows:

Referring to FIGS. 1 and 2, a radio glaze 25 is fired over the mounting flange 6 and the immediately adjacent portions of the bushing shell 5. The radio glaze 25 should at least project the opposite sides of the mounting flange 6 by a distance generally corresponding to the length of the mounting flange and preferably extends outwardly to the undersurface of the first skirt. A second ring of radio glaze 26 is applied to the inner end of the shell 5 to underlie the silver coating 21. The radio glazes 25 and 26 each may be a suitable ceramic coating containing iron oxides which is applied and fired to form an integral part of the housing shell 5. The radio glazes 25 and 26 are a material having an intermediate resistivity such as 1 to 20 megohms per square.

An insulating glaze 27 is fired to the exterior surface of the inner portion of the bushing shell between the first and second radio glazes 25 and 26. The silver coating conductor 21 is applied over the radio glaze 25 to the underside of the mounting flange 6 and extends inwardly as a continuous coating over the insulating glaze 27 down to and including an initial area of the innermost radio glaze ring 26. An innermost insulating glaze 28 overlaps the inner radio glaze ring 26 on the inner end and extends to near terminal 14.

The radio glaze rings 25 and 26 provide an intermediate impedance electrical coating which is fired to the outer surface of the insulating porcelain housing. The radio glazes thus provide an intimate and long life interconnection to the shell 5 which is maintained under normal expected environments in which the bushing is used to grade the voltage stresses and avoid edge effects due to abrupt transitions of resistance. Further, the intermediate impedance characteristic is such that there is essentially no electrolytic cell action created with the aluminum clamping unit 7, thereby further contributing to a reliable electrical operation and performance of the bushing.

The radio glazes furnish a smoother transition between the conductive silver coating 21 and insulating glaze. The combination of radio glaze with insulating glaze and conductive coating further contributes to obtain the desired distribution of the electric field with a minimization of stress points on the porcelain and the like.

The outer surface of the shell 5 from the radio glaze 25 to the outer terminal 15 is also preferably provided with an insulating glaze.

As previously noted, the clamping unit 7 firmly secures the bushing shell 5 to the device housing 2. The mounting hardware or unit 7 includes an aluminum ring 29, an annular clamp ring 30, and a plurality of suitable circumferentially spaced clamping bolts 31. The aluminum ring 29 rests on the flange 6 underneath the clamp ring 30. The bolts 31 pass through the ring 30 and thread into the housing 2 and firmly clamp the flange 6 against the housing 2. The clamp unit 2 further includes an inner conductive gasket 32 interposed between the silver coated flange 6 and the housing 2. The conductive gasket 32 is formed of a resilient rubber-like material within which conductors 33 are dispersed. For example, applicants have used a gasket 32 formed of epichlorohydrin which provides a highly effective cushioned mounting and a fluid-tight seal. The conductors 33 are dispersed throughout the resilient gasket material. In a preferred construction, a plurality of metal staples 33 are essentially embedded in the resilient material and project from opposite faces to engage the silver coating 21 on one side and the housing wall 2 on the opposite side. A sufficient number of staples 33 are introduced into the gasket 32 to provide low resistance and therefore good conduction paths between the silver coating 21 and the housing 2, the staples preferably having a very low resistance, in the milliohm range. The staples or other conductive material is preferably selected from a group of metals having electrochemical potentials generally midway between silver and aluminum to reduce electrolytic corrosion. Bronze is preferred.

The good conductivity provided by the conductive gasket 32 maintains the coated exterior of the bushing at the reference potential of the device housing 2 and thereby minimizes generation of internal electrical discharge as the result of electrostatic charge characteristics of the housing mounted bushing.

Where the high voltage connection is made within an oil, it is, of course, important to maintain a proper field distribution at the innermost end adjacent the high voltage connection. Although the bushing with the tubular conductor and the specially coated bushing shell 5 may provide fully adequate and reliable operation, a funnel shaped corona shield 22 is applied, as shown, to more positively create a proper field distribution. The corona shield 22 provided at the inner end of the bushing in conjunction with coating 21 and glazes 26 and 28 serves to distribute the field along the bushing. The corona shield 22 is particularly effective in further avoiding edge effects at the inner end of conductive coating 21 and in assuring that internal structures of the enclosure 2 are only in close proximity to portions of the bushing which are at the same potential. In the presence of corona and during current interruption under oil, the insulating properties of the oil are degraded and potentially explosive gases are generated. Thus, the funnel shaped corona shield 22 includes a metal conducting tube end 35 clamped to the bushing by any suitable clamp means, shown as a screw operated band clamp 36. Shield 22 includes slots 37 extending through tube portion 35 into a conical portion of the shield. The slots 37 in the tube portion 35 permit slight collapse of the mounting end of the shield 22 for firm electrical interconnection to the silver conductor 21.

A locating ring 38 is interposed between the shield 22 and the bushing shell 5 and located in a groove in the outer wall of the bushing shell. The ring is preferably formed of a resilient elastomer material, such as Buna N or silicone rubber.

In accordance with another aspect of the illustrated embodiment of the present invention, the shield 22 is specially formed with opening means which extend to the opposite side of the locating ring 38. Slots 37 serve as opening means to prevent trapping of gases beneath the conical portion of shield 22. As earlier stated, the gases can allow undesired voltage stresses and are potentially explosive. The opening means can be provided in any shape or arrangement. For example, a plurality of individual drilled openings may be dispersed throughout the skirt. Alternatively, the clamping slots 37 may be extended downwardly beyond the locating ring 38 as at 40. The opening means in the shield 22 thus extend at least throughout the area between the ring and the mounting clamp to release air and any other gases which may rise.

The opposite ends of the conductor rod 11 are sealed to the bushing shell 5 by the liquid fluid tight sealing means 12 and 13.

The inner end sealing means 12 includes a generally T-shaped or flanged seal member 41 having a hub 42 which surrounds the end of the conductor rod 11. Seal member 41 cooperates with gaskets to provide both axial sealing with respect to rod 11 and radial sealing with respect to shell 5. The conductor rod 11 is recessed and has an axial O-ring seal 43 interposed between the hub 42 and the rod 11. The flange 44 of the T-shaped seal member 41 and the flat end of the shell 5 abut. An O-ring seal 45 disposed within a recess in the flange sealingly engages the flat end of the porcelain shell 5 which is preferably ground flat to establish a smooth reliable radial sealing surface. The seal member 41 is clamped in sealing engagement with the end face of the porcelain shell 5 by a spanner clamp nut 46. The nut 46 is threaded and bonded onto the threaded terminal 14 and into clamping engagement with the T-shape member to hold it in firm abutting and sealing engagement with the porcelain housing. The two O-rings prevent fluid leakage along the rod 11 and between the end face of the shell 5 and the seal member 41 flange. The O-ring seal members may be formed of any suitable material, such as a silicone elastomer.

The top sealing means 13 also includes a T-shaped sealing member 47 abutting a ground flat end of the porcelain shell 5, with the rod 11 passing through the hub 48. Sealing means 13, similar to sealing means 12, includes axial and radial seals. O-ring seal 49 provides an axial seal and, O-ring 50 provides a radial seal.

A pair of spring washers 51 with suitable thrust guides 52, 52 and thrust washers 53 and 54 to the opposite sides thereof are mounted on the flange. The thermal expansion coefficients of the rod 11 and the shell 5 generally differ. Springs located at one of the sealing means 12 or 13 will compensate for differential thermal expansion to maintain sealing engagement at both ends of the bushing. The illustrated spring washers 51 are 300 series stainless steel washers, but other annular spring washers may be used. An exterior terminal connector 55 includes a cup-shaped base member 56 threaded onto a threaded extension 15 of the rod 11 and projects downwardly as a spring assembly housing over the spring assembly 51, 53, 54 and the exterior of the bushing shell 5. The base member 56 compresses the spring washers onto the sealing member 47 and establishes a resilient, fluid tight connection. The exterior portion of the porcelain seal 5 is provided with suitable locking notches 57 for receiving locking screws 58 threaded through aligned openings in the cup-shaped base member to establish a positive non-removable engagement with the porcelain housing. An alternative incorporates protrusions cast into the cup-shaped base member which index into notches 57 provided in shell 5. This disc spring-loaded sealing means establishes a long life reliable seal of the housing without danger of chipping the internal portion of the housing.

It should be understood that various modifications changes and variations may be made in the arrangement, operation and details of construction of the elements disclosed herein without departing from the spirit and scope of our invention.

We claim:

1. A high voltage electrical assembly comprising:

a metal enclosure containing a first dielectric fluid, said enclosure having a top provided with an opening therethrough;

a high voltage bushing extending through said opening in the top of said enclosure;

said bushing including, a tubular shell of electrical insulating material having a portion extending above the top of said enclosure and terminating in an outer end, and a portion passing through said opening in the top of said enclosure and terminating in an inner end immersed in said first dielectric fluid, said shell having a portion of its exterior surface coated with a conductive material, with the conductive material extending from the enclosure top to a substantial extent into said first dielectric fluid;

a conductor coaxially maintained within the interior of said shell and spaced therefrom, said conductor extending beyond said inner and outer ends of said shell;

a second dielectric fluid filling a chamber defined by a radial space between said conductor and said shell and an axial space from somewhat below the top of the chamber to its bottom which spaces are not occupied by other components of the bushing;

sealing means disposed near said outer end and near said inner end of said shell to maintain the coaxial mounting of said conductor within said shell and to retain said second dielectric fluid within the chamber;

a tubular insulating member surrounding said conductor for a substantial portion of its length within the chamber; and a conductive tube in close association with said insulating member for a substantial portion of its length, to establish a floating equipotential surface intermediate between a voltage of said enclosure and a supply voltage to said bushing;

and said assembly further comprising, a conductive gasket, said gasket resiliently sealing an interface between said enclosure and said shell, and said gasket electrically connecting the conductive material on said shell to the enclosure; and mounting means cooperating between said shell and said enclosure and compressing said gasket between said shell and said enclosure to maintain a seal between them.

2. The assembly as claimed in claim 1 wherein said gasket comprises a resilient material and a plurality of discrete conductors scattered throughout said resilient material and projecting from the gasket surfaces.

3. The assembly as claimed in claim 2 wherein the discrete conductors are staples projecting through said resilient material.

4. The assembly as claimed in claim 3 wherein the discrete conductors are bronze and said resilient material of said gasket is epichlorohydrin.

5. The assembly as claimed in claim 1 wherein a conductive portion of said conductive gasket has an electrochemical potential between the electrochemical potential of the conductive material and the electrochemical potential of the enclosure.

6. The assembly as claimed in claim 1 wherein said sealing means includes:

a radial "O" ring seal to prevent dielectric fluid loss in a radial direction from said conductor; and an axial "O" ring seal to prevent dielectric fluid loss in an axial direction along said conductor.

7. The assembly as claimed in claim 6 wherein said radial seal is compressed in an axial direction by spring means.

8. The assembly as claimed in claim 7 wherein said spring means is a plurality of spring washers adjacent one end of said shell.

9. The assembly as claimed in claim 1 wherein said tubular shell is manufactured from porcelain and the exterior surface of the shell is a glaze.

10. The assembly as claimed in claim 1 wherein said conductive tube is a metalic foil sandwiched between an insulating mandrel and an insulating covering to form a tubular conductive sandwich without voids between layers, the insulating mandrel being radially spaced from said tubular insulating member.

11. The assembly as claimed in claim 10 wherein the insulating mandrel and the insulating covering are insulating films wrapped within and without said metal foil.

12. The assembly as claimed in claim 11 wherein the insulating mandrel and the insulating covering are polyethylene terephthalate and the foil is aluminum.

13. The assembly as claimed in claim 10 wherein said conductive tube, said tubular insulating member and said conductor are sufficiently spaced from each other to allow said second dielectric fluid to infiltrate between them.

14. The assembly as claimed in claim 13 wherein the insulating mandrel and the insulating covering are polyethylene terephthalate film wrapped within and without the foil and the foil is aluminum.

15. The assembly as claimed in claim 13 wherein a plurality of conductive tubes, each spaced from the other to allow infiltration of dielectric fluid, surround said conductor.

16. The assembly as claimed in claim 1 wherein said tubular insulating member is polypropylene.

17. The assembly as claimed in claim 1 further including a funnel-shaped corona shield having narrow and wide cross sections, said corona shield having opening means for releasing gases from beneath the wide cross section portion of said shield, said shield being clamped into electrical connection with the conductive material on the exterior surface of said shell.

18. The assembly as claimed in claim 17 further including an insulating locating ring extending around said shell at a location appropriately spaced from said conductive material to position the narrow cross section portion of said corona shield about said conductive material.

19. The assembly as claimed in claim 18 wherein the opening means are axial slots extending through the narrow cross section portion of said corona shield and into the wide cross section portion of said corona shield beyond the position of said locating ring.

* * * * *